US010478694B2

(12) United States Patent
Dettor et al.

(10) Patent No.: US 10,478,694 B2
(45) Date of Patent: Nov. 19, 2019

(54) TENNIS NET ANCHORING DEVICE AND METHOD OF ANCHORING A TENNIS NET

(71) Applicant: Fast-Dry Corporation, Pompano Beach, FL (US)

(72) Inventors: Todd Monroe Dettor, Pompano, FL (US); Richard Christopher Buerkle, Atlantis, FL (US)

(73) Assignee: FAST-DRY CORPORATION, Pompano Beach, FL (US)

( * ) Notice: Subject to any disclaimer, the term of this patent is extended or adjusted under 35 U.S.C. 154(b) by 0 days.

(21) Appl. No.: 15/981,740

(22) Filed: May 16, 2018

(65) Prior Publication Data

US 2018/0333623 A1 Nov. 22, 2018

Related U.S. Application Data

(60) Provisional application No. 62/507,190, filed on May 16, 2017.

(51) Int. Cl.

| | |
|---|---|
| ***A63B 61/00*** | (2006.01) |
| ***A63B 61/02*** | (2006.01) |
| *A63B 102/02* | (2015.01) |
| *A63B 61/04* | (2006.01) |

(52) U.S. Cl.

CPC ..... *A63B 61/02* (2013.01); *A63B 61/00* (2013.01); *A63B 61/04* (2013.01); *A63B 2102/02* (2015.10)

(58) Field of Classification Search

CPC ..... A63B 61/00; A63B 61/003; A63B 61/04; A63B 61/02; A63B 2102/02; F16B 45/00

USPC ..... D8/372; 211/106.1; 294/143; 248/301, 248/304, 340

See application file for complete search history.

(56) References Cited

U.S. PATENT DOCUMENTS

| | | | | | |
|---|---|---|---|---|---|
| 427,642 | A | * | 5/1890 | Wack | D06F 53/04 248/353 |
| 1,616,013 | A | * | 2/1927 | Warren | B68B 5/02 24/577.1 |
| D117,674 | S | * | 11/1939 | Lewis | 428/28 |
| 3,055,333 | A | * | 9/1962 | Stanley | B63B 21/04 114/210 |
| D211,971 | S | * | 8/1968 | Lasko | D12/215 |

(Continued)

*Primary Examiner* — Raleigh W Chiu
(74) *Attorney, Agent, or Firm* — Mark C. Johnson; Johnson | Dalal

(57) ABSTRACT

A tennis net anchoring device and method securely anchors a tennis net center strap to a recessed anchor post on a tennis court surface. The anchoring device comprises a longitudinal, double-sided, unitary body supporting a net-retention member and a ground-retention member. A top portion of the unitary body includes two arcuate T-shaped, net-retention members that retain the tennis net through grommet holes in the net. The net-retention members extend downwardly from the upper end of the middle portion to define an arcuate net-support surface. A lower portion of the unitary body includes two off-set, J-shaped ground-retention members, opposite the net-retention members. The ground-retention members have a ground-retention surface that forms an anchor post insertion channel. The insertion channel enables insertion of an anchor post recessed beneath the court surface. The ground-retention members have free ground ends that enable maneuvering of the anchor post within the anchor post insertion channel.

20 Claims, 10 Drawing Sheets

(56) References Cited

U.S. PATENT DOCUMENTS

| | | | | |
|---|---|---|---|---|
| D248,087 | S | 6/1978 | Feldman | |
| 4,097,015 | A * | 6/1978 | Frishman | F16B 45/00 24/697.2 |
| D248,541 | S * | 7/1978 | Oberg | D8/372 |
| D296,416 | S * | 6/1988 | Fawcett | D8/354 |
| 4,973,055 | A | 11/1990 | Muir | |
| 5,393,051 | A | 2/1995 | Merino et al. | |
| 6,179,317 | B1 | 1/2001 | Hurst et al. | |
| 6,299,001 | B1 | 10/2001 | Frolov et al. | |
| 7,748,673 | B2 * | 7/2010 | Barrese | A47H 13/00 24/716 |
| 8,182,182 | B2 | 5/2012 | Tardif et al. | |
| 2015/0126346 | A1 | 5/2015 | Kaye et al. | |
| 2018/0135729 | A1 * | 5/2018 | Shen | F16G 11/14 |

* cited by examiner

TENNIS NET ANCHORING DEVICE AND METHOD OF ANCHORING A TENNIS NET

FIELD OF THE INVENTION

The present invention relates to a tennis net anchoring device and method for anchoring a tennis net to a tennis court surface.

BACKGROUND OF THE INVENTION

Typically, the game of tennis utilizes a mesh tennis net that stretches across the tennis court surface in a vertical disposition at the center of the tennis court from side to side. The net is supported by end posts that position outside the sidelines at a height of 42". Usually, the center of the tennis net is positioned at a height 36" above the tennis court surface.

Generally, tennis court surfaces provide anchor posts at the center of the court. The anchor posts are provided to secure a strap or grommet about the center of the tennis net so as to adjust the height of the tennis net. The anchor post may be staked, cemented, or otherwise sunk in the surface of the tennis court so as to rigidly fix the mount. The point where the tennis net strap attaches to the anchor post may be somewhat above or below the surface of the tennis court.

It is recognized that the center region of the tennis net, when untethered, allows the tennis net to sway laterally when struck by a tennis ball or is affected by the wind. This can be undesirable when the players are gauging the depth of the net for striking the tennis ball. A central strap, or bottom grommets are often part of the bottom portion of the tennis net. Also, the anchor post is often worn down by the connecting means to the tennis net.

Therefore, a need exists to overcome the problems with the prior art as discussed above

SUMMARY OF THE INVENTION

The invention provides a net anchoring device and method for anchoring a tennis net to a tennis court surface that overcomes the hereinafore-mentioned disadvantages of the heretofore-known devices and methods of this general type and that includes an anchoring device comprising a unitary body of a rigid material defined by a top portion, a middle portion, and a lower portion. The unitary body is also defined by a generally linear shape. The middle portion of the unitary body is defined by an upper end and a bottom end opposing the upper end. The upper end orients towards the tennis net, while the bottom end orients towards the tennis court surface.

In some embodiments, the anchoring device includes two net-retention members for supporting a tennis net. The net retention members are defined by an arcuate T-shape. Each net-retention member extends downwardly from the upper end of the middle portion to define an arcuate net-support surface.

The net-support surface faces in a direction toward the bottom end of the middle portion. The net-support surface of each respective net-retention member is aligned with one another and have corresponding shapes. Both net-retention members terminate at respective free net ends, and both net-retention members flanking the middle portion.

In some embodiments, the anchoring device includes two ground-retention members that attach to a recessed anchor post recessed beneath the tennis court surface. The anchor post is defined by a generally J-shape. The ground-retention members extend downwardly from the bottom end of the middle portion. Each ground-retention member has an arcuate portion with a ground-retention surface facing in a direction toward the net-support surfaces of the net-retention members.

The ground retention surface of each respective ground-retention member is aligned with one another and has a corresponding shape. Both ground-retention members terminating at respective free ground ends, and both ground-retention members are disposed in off-set configurations with respect to the middle portion.

In accordance with another feature, an embodiment of the present invention includes a unitary body defined by a linear, tubular shaft.

In accordance with a further feature of the present invention, the net-support surface supports a bottom grommet of a tennis net extending across the tennis court surface.

In accordance with a further feature of the present invention, the bottom end of the middle portion is oriented to a tennis court surface.

In accordance with another feature, an embodiment of the net-retention member includes a first arm that extends laterally from the middle portion of the unitary body in the same direction and orientation as a first ground-retention member.

In accordance with another feature, an embodiment of the net-retention member includes a second arm that extends laterally from the middle portion of the unitary body in the same direction and orientation as a second ground-retention member.

In accordance with a further feature of the present invention, the ground-retention member is disposed in an inversely symmetrical orientation with respect to the unitary body.

In accordance with a further feature of the present invention, the ground-retention surface of each respective ground-retention member is aligned with one another and have a corresponding shape.

In accordance with yet another feature, the ground-retention surface forms an anchor post insertion channel operable to enable insertion of an anchor post.

In accordance with a further feature of the present invention, the anchor post comprises a rigid hook member that is recessed below a tennis court surface.

One objective of the present invention is to provide a net anchoring device that does not have any moving parts that would otherwise "jam up" or wear down from repetitive use.

Another objective is to provide a net anchoring device having a hook that is shorter and closer to the ground than typical anchor clips. This is better for both aesthetics and the wear on the net itself Another objective is to provide a net anchoring device that is quicker and easier to install as there are no moving parts.

Another objective is to provide a net anchoring device with two separate contact points on the anchor post that do not allow it to rub and wear down the anchor post as quickly as those known net anchors.

Yet another objective is to stabilize a tennis net from beneath the tennis court surface while a tennis game is played.

Yet another objective is to provide a hidden, unobtrusive anchoring means for the bottom side of a tennis court.

Yet another objective is to enable facilitated insertion of the anchor post across the ground-retention surface.

Yet another objective is provide an inexpensive to manufacture a tennis court net anchoring device and method of operation.

Although the invention is illustrated and described herein as embodied in a tennis net anchoring device and method of attachment to a tennis court, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the middle portion of the unitary body.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DESCRIPTION OF THE INVENTION

Figure 11:
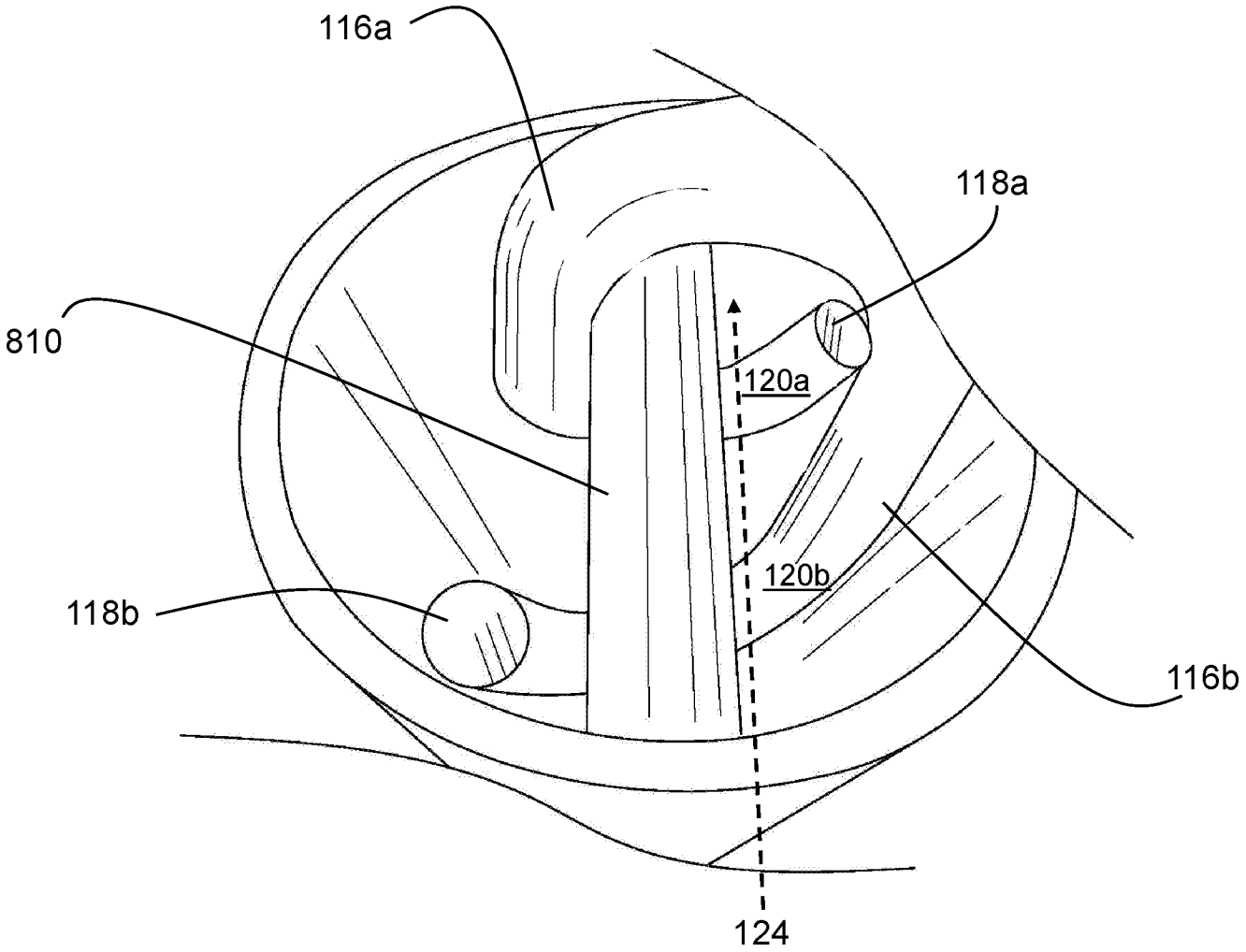
FIG. 11 is a close-up view of the ground-retention members hooked around the anchor post, in accordance with the present invention.
Figure 12:
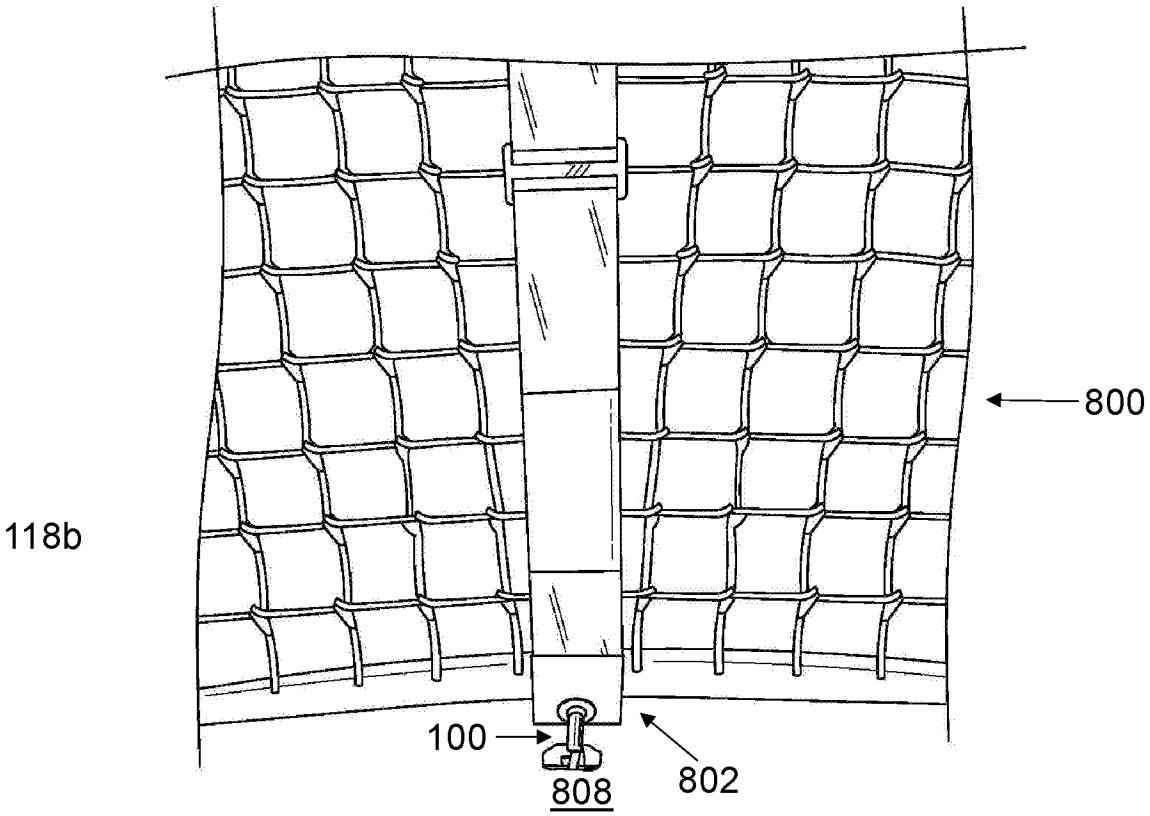
FIG. 12 is a perspective view of the anchoring device anchoring a center bottom portion of the tennis net across the tennis court surface, in accordance with the present invention.

The invention provides a tennis net anchoring device 100 that is double-sided and beneficially anchors a tennis net 800 more effectively than known devices and/or methods (as best shown in FIG. 12). Specifically, with reference to FIGS. 1-7 and 9-12, the inventive anchoring device 100 is illustrated. FIG. 8 references a prior-art device 800 employed with a conventional tennis net. The anchoring device 100 provides a unique way of attaching a single folded strap with two grommeted or looped ends of the anchoring device 100 to an anchor post 810 that is recessed below a tennis court surface 808. The device 100 is designed for tennis use, and specifically employed to connect the net center strap of the tennis net 800 to the anchor post 810 in the tennis court surface 808. Although the invention is illustrated and described herein as embodied in a tennis net tie-down or anchoring hook and method of use, it is, nevertheless, not intended to be limited to the details shown because various modifications and structural changes may be made therein without departing from the spirit of the invention and within the scope and range of equivalents of the claims. For example, the device 100 is also useful with any application where attaching a single folded strap or rope to a fixed anchor post 810 is needed. In another example, the anchoring device 100 may be operable with various nets used in sports and games.

Well-known elements of exemplary embodiments of the invention will not be described in detail or will be omitted so as not to obscure the relevant details of the invention. The invention possesses numerous advantages over the current style of anchor clips (again, as shown in FIG. 12). The anchoring device 100 may not have any moving parts that would otherwise "jam up" or wear down from repetitive use. The advantageous configuration and shape of the anchoring device 100 also provides a unitary body 102 that is shorter and closer to the ground than a typical anchor clip 800 used for similar anchoring purposes (FIG. 8). This is better for both aesthetics and the wear on the net itself. As can be seen in FIG. 8, the prior art anchor clip 800 is more elongated, and thereby allows for more free play by the tennis net 800, resulting in excessive swaying/flapping of the tennis net 800.

In another advantage, the anchoring device 100 is also much quicker and easier to install as there are no moving parts. The prior art anchor clip 800 includes opposing spring-loaded clips 812*a*, 812*b* that slide in two directions to clip the bottom grommet 804 in the tennis net 800, and anchor post 810 in the tennis court surface 808 from opposing sides.

Lastly, with two separate contact points on the anchor post 810, the anchoring device 100 does not rub and wear down the anchor post 810 in the tennis court surface 808 as quickly than those known net anchors. The prior art anchor clip 800 includes uses a single connection means to attach to the anchor post 810, which creates a concentrated rubbing effect on the anchor post 810.

Some detailed embodiments of the present invention are disclosed in FIGS. 1-7 and 9-12; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. It is believed that the invention will be better understood from a consideration of the following description in conjunction with the drawing figures, in which like reference numerals are carried forward. The figures of the drawings are not necessarily drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the bottom of the hook having the two ground-retention members 116*a-b* ("J hooks") to the top of the hook having the curved net-retention members 110*a-b* ("T hook").

Figure 5:
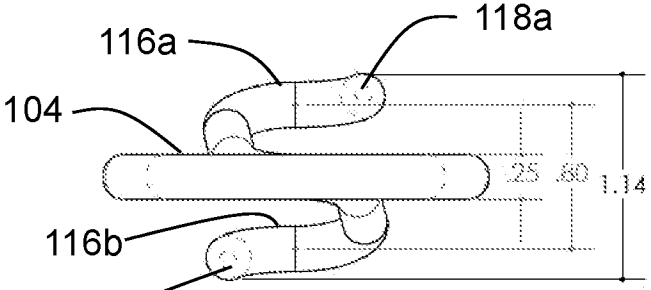
FIG. 5 is a top view of the tennis net anchoring device shown in FIG. 1, referencing the dimensions of the net-retention members and ground-retention members, in accordance with the present invention.
Figure 6:
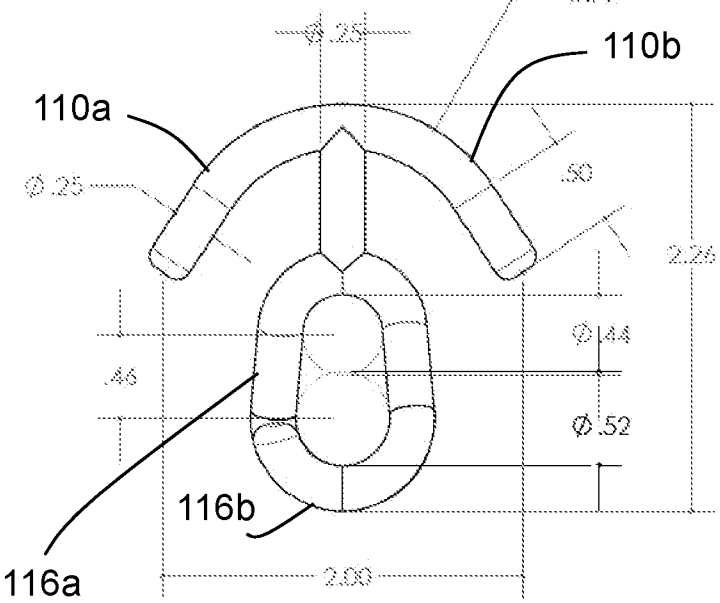
FIG. 6 is an elevational side view of the tennis net anchoring device shown in FIG. 1, referencing the dimensions of the net-retention members and ground-retention members, in accordance with the present invention.
Figure 7:
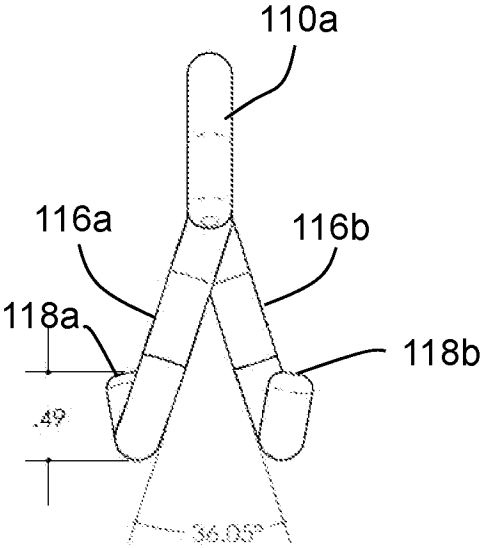
FIG. 7 is a perspective front view of the tennis net anchoring device shown in FIG. 1, referencing the dimensions of the net-retention members and ground-retention members, in accordance with the present invention.
Figure 8:
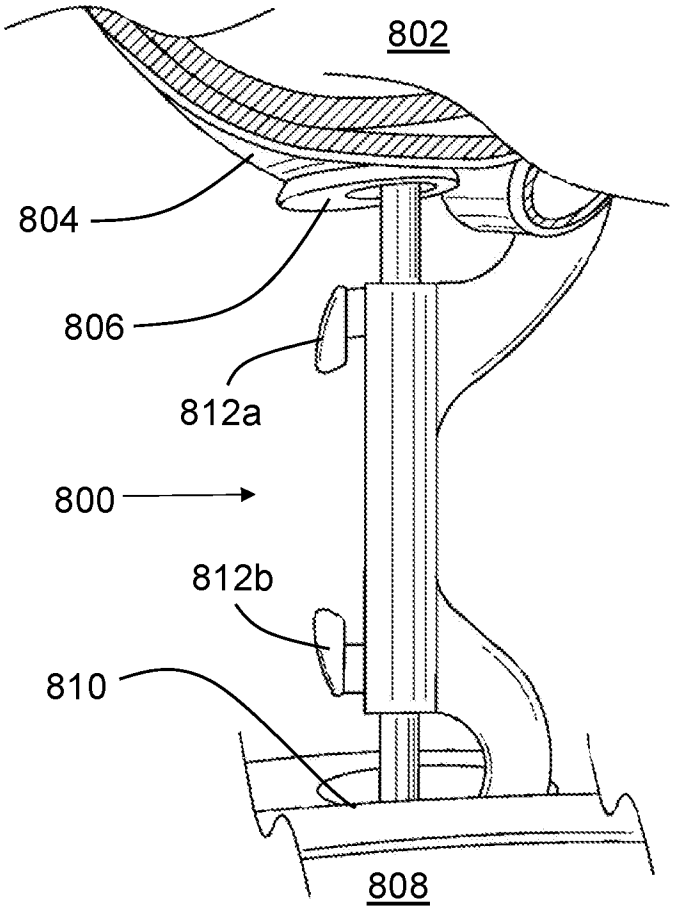
Prior Art FIG. 8
FIG. 8 is a perspective front view of a tennis net anchoring device in accordance with the prior art.

Referring now to FIGS. 1-7, one embodiment of the present invention is shown in various views (FIGS. 1-5) and with exemplary dimensions and configuration (FIGS. 5-7). Said figures show several advantageous features of the present invention, but, as will be described below, the invention can be provided in several shapes, sizes, combinations of features and components, and varying numbers and functions of the components.

As depicted in FIG. 12, the anchoring device 100 works to anchor the central, bottom portion 802 of the tennis net 800 to the tennis court surface 808. Those skilled in the art will recognize that the bottom portion 802 of the tennis net 800, when untethered, allows the tennis net 800 to sway laterally when struck by a tennis ball or when the wind blows. This can be undesirable when the players are gauging the depth of the tennis net 800 for striking the tennis ball. The anchoring device 100 is effective in anchoring this central, bottom portion 802 of the tennis net 800 to a recessed anchor post 810 in the tennis court surface 808.

Figure 1:
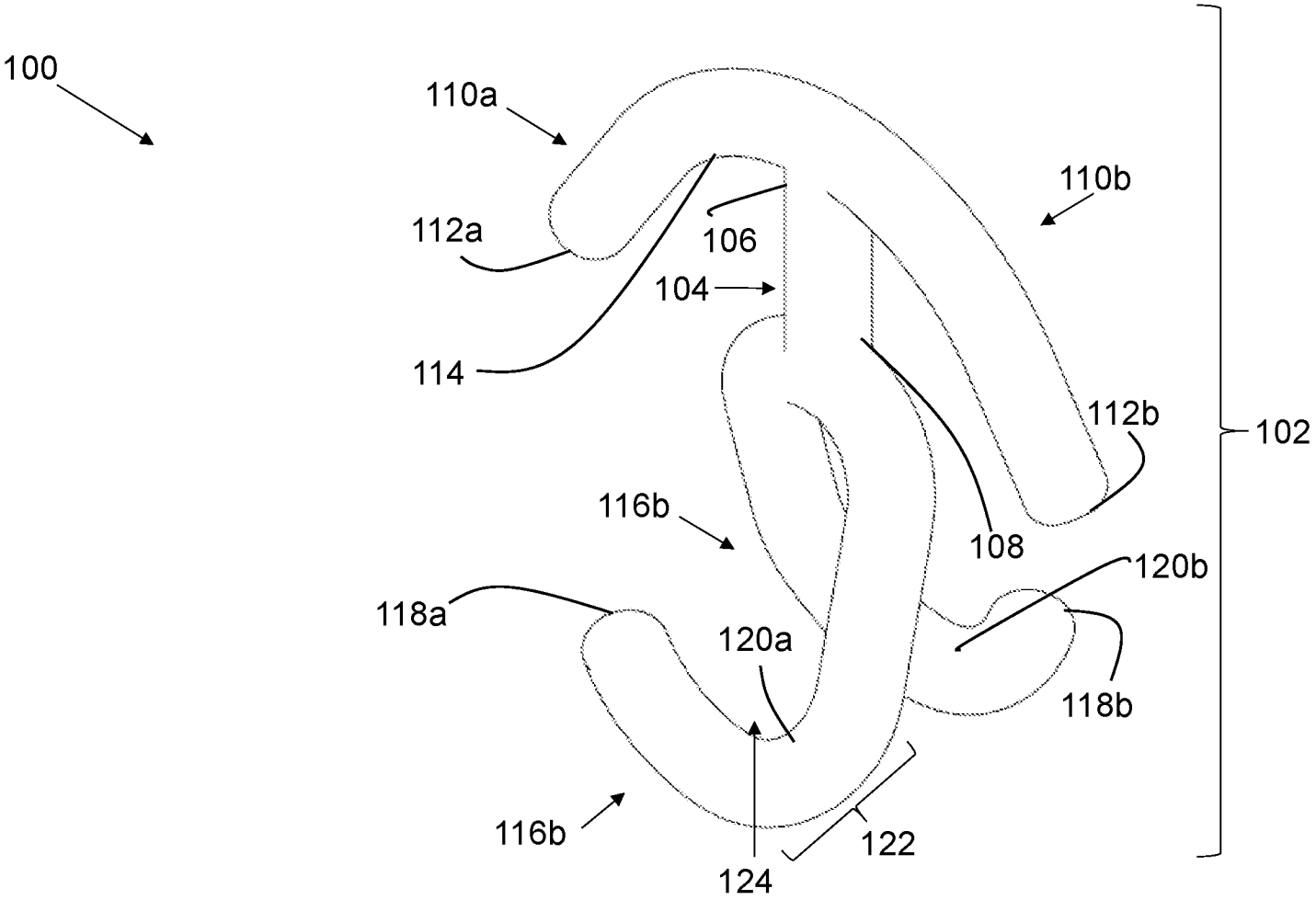
FIG. 1 is a perspective side view of a tennis net anchoring device, in accordance with the present invention.
Figure 2:
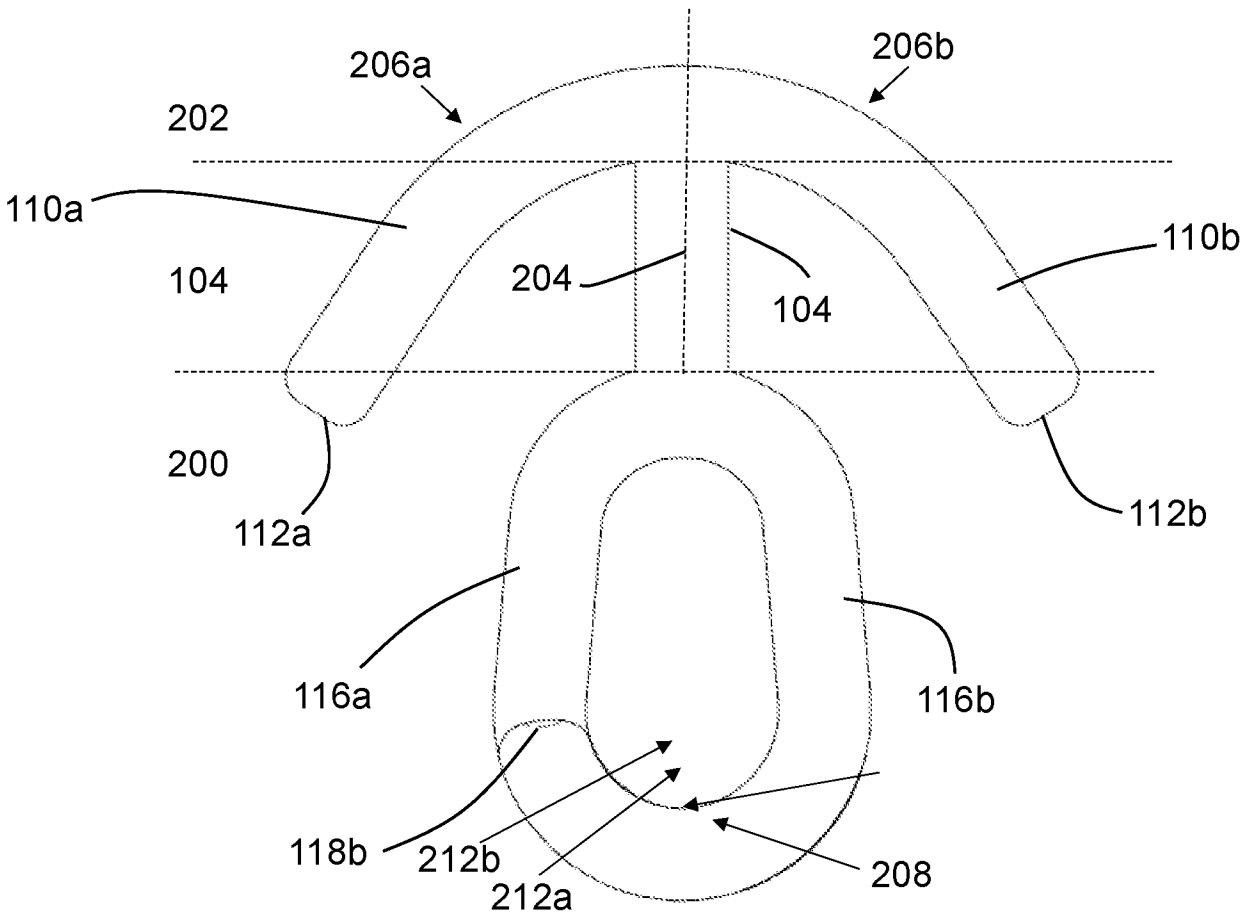
FIG. 2 is an elevational side view of the tennis net anchoring device shown in FIG. 1, in accordance with the present invention.

As referenced in FIG. 1, the anchoring device 100 comprises a unitary body 102 that is rigid and has no moving parts. The unitary body 102 is defined by a lower portion 200, a middle portion 104, and a top portion 202 that may be delineated with imaginary lines as best shown in FIG. 2. As FIG. 6 references, the unitary body 102 may have a length of 2.26".

The middle portion 104 may include a tubular shaft that is defined by a generally linear shape. Use of such a simple shaft minimizes moving parts for the anchoring device 100. The middle portion 104 is further defined by an upper end 106 and a bottom end 108 opposing the upper end 106. The upper end 106 orients towards a tennis net 800, while the bottom end 108 orients towards a tennis court surface 808. In one non-limiting embodiment, the unitary body 102 may be tubular stainless steel or other rigid material, e.g., PVC plastic. AS FIG. 5 references, the middle portion 104 may have a width of 0.25".

Figure 3:
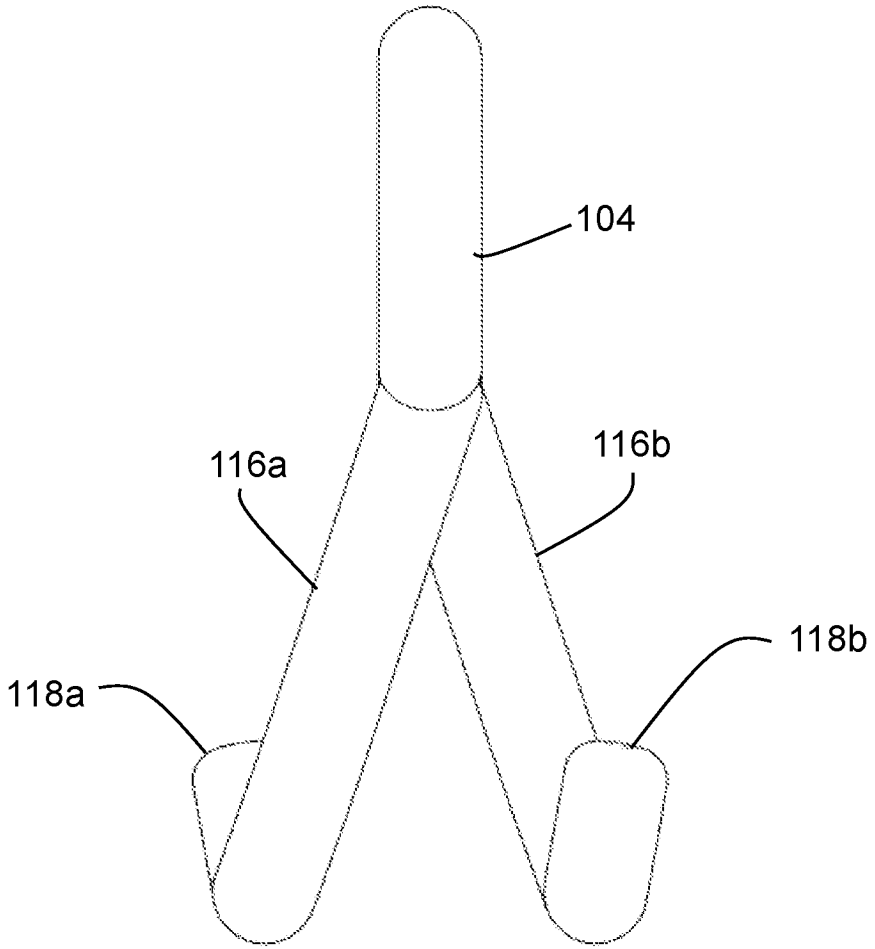
FIG. 3 is a perspective front view of the tennis net anchoring device shown in FIG. 1, in accordance with the present invention.
Figure 4:
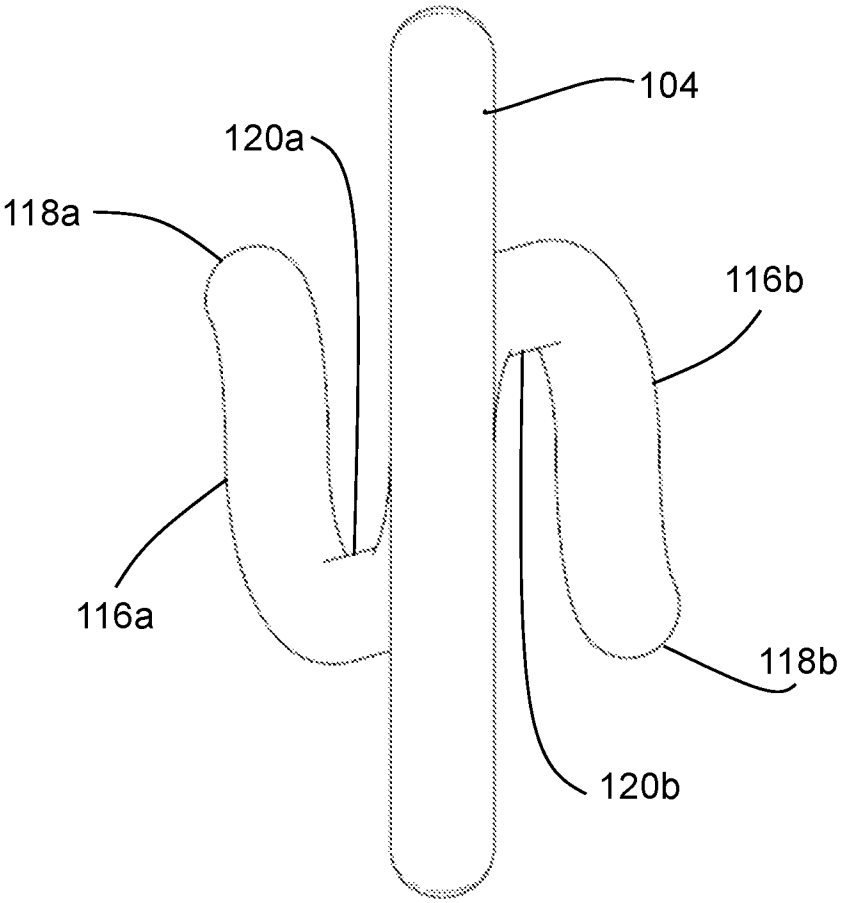
FIG. 4 is a perspective rear view of the tennis net anchoring device shown in FIG. 1, in accordance with the present invention.

Turning now to FIG. 3, the middle portion 104 of the unitary body 102 is defined by a linear, upright portion interposed between two net-retention members 110*a-b* and two ground-retention members 116*a-b*. The middle portion 104 may has a height that at least partially dictates (along with the height of the ground-retention members 116*a-b*) the spacing between the bottom portion 802 of the tennis net 800 and the tennis court surface 808 (as shown best in FIG. 9). Thus, the unitary body 102 has a height that maintains the tennis net 800 in close proximity to the tennis court surface 808.

As seen in the figures, the top portion 202 of the anchoring device 100 has two arcuate net-retention members 110*a-b*. The net-retention members 110*a-b* provide support for the bottom portion 802 of the tennis net 800. In some embodiments, the net-retention members 110*a-b* may be defined by an arcuate T-shape that spans laterally away from the middle portion 104. Both net-retention members 110*a-b* terminate at respective free net ends 112*a-b*. And both net-retention members 110*a-b* flank the middle portion 104. In some embodiments, the net-retention members 110*a-b* may be tubular stainless steel or other rigid material, e.g., PVC plastic. As FIG. 6 references, the net-retention members 110*a-b*, have a radius of 0.99.

As seen best in FIG. 2, the net-retention members 110*a-b* have two similar, but opposing arms 206*a-b*. A first arm 206*a* of the net-retention members 110*a-b* extends laterally from the middle portion 104 in the same direction and orientation of as a first ground-retention member 116*a*. Similarly, a second arm 206*b* of the net-retention members 110*a-b* extends laterally from the middle portion 104 in the same direction and orientation as a second ground-retention member 116*b*. In one embodiment, the bottom portion 208 and/or surfaces 210 of the ground-retention member 116*a-b* define circular areas 212*a-b* that are concentric with one another. The surfaces 210 and/or areas 212*a-b* of each ground-retention member 116*a-b* may also substantially correspond with one another in shape and size to provide and/or effectuate a more structurally stable, reliable, and/or level support surface for the net 800 than other known devices.

Each net-retention member 116*a-b* extends downwardly from the upper end 106 of the middle portion 104 to define an arcuate net-support surface 114. The net-support surface 114 faces in a direction toward the bottom end 108 of the middle portion 104. The net-support surface 114 of each respective net-retention member 110*a-b* is aligned with one another and have corresponding arcuate, T shapes.

Figure 10:
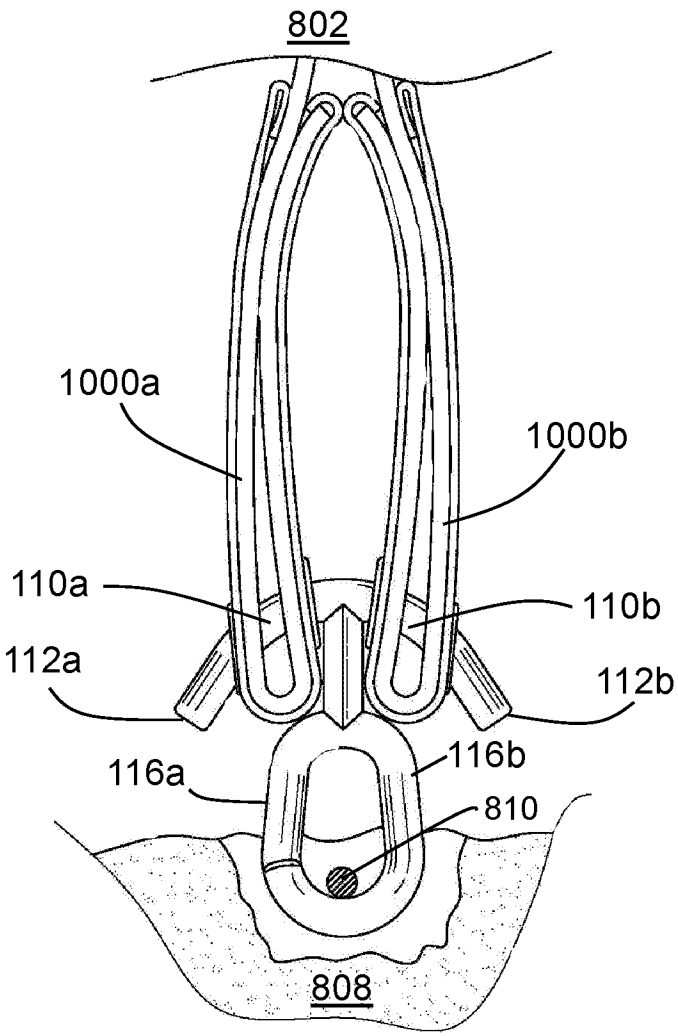
FIG. 10 is a close-up view of the tennis net anchoring device, showing net straps wrapped around the net-retention members, and the ground-retention members hooked around the anchor post, in accordance with the present invention.

In some embodiments, the bottom surfaces of the net-retention members 110*a-b* (particularly because of the downwardly facing angle of the arms) effectively support the folded bottom portion 802 of the tennis net 800 (as best shown in FIG. 10). In another non-limiting embodiment, the net-support surface 114 supports a grommet, hole, or other portions of the tennis net 800. Specifically, the net-support surface 114 supports a bottom grommet 804 of a tennis net 800 extending across the tennis court surface 808.

Though, as shown in FIG. 10, a pair of net straps 1000*a*, 1000*b* from the bottom portion 802 of the tennis net 800 wrap around their respective arms 206*a-b* of the net-retention members 110*a-b*. In this manner, the T-shaped, arcuate configuration of the net-retention members 110*a-b* are easily hooked through the bottom grommet 804 for connection to the tennis net 800, and then released to form a secure connection with the bottom portion 802 of the tennis net 800.

Figure 9:
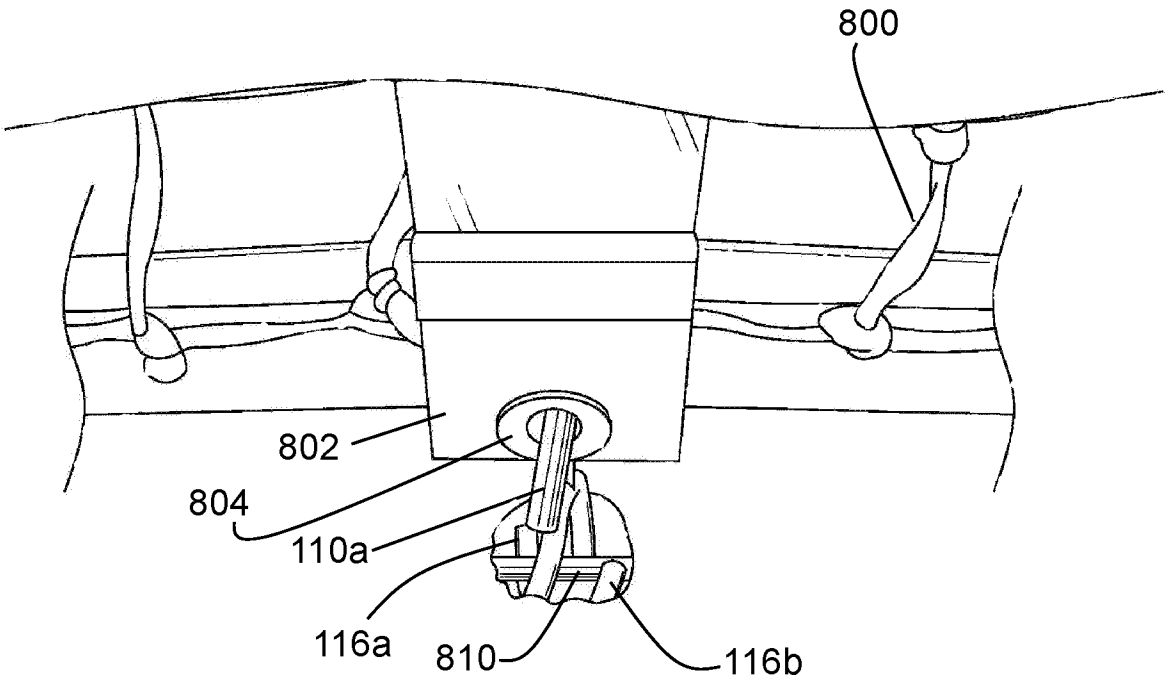
FIG. 9 is a perspective view of the tennis net anchoring device connecting the bottom portion of the tennis net to the anchor post recessed beneath the tennis court surface, in accordance with the present invention.

As depicted in FIG. 9, the lower portion 200 of the unitary body 102 may also include two curvilinear ground-retention members 116*a-b* that attach to an anchor post 810 recessed beneath the tennis court surface 808. The anchor post 810 is generally provided to secure a strap or grommet about the bottom portion 802 of the tennis net 800. This can be useful for adjusting the height of the tennis net 800. The anchor post 810 may be staked, cemented, or otherwise sunk in the surface of the tennis court so as to rigidly fix the ground-retention members. Though in one embodiment, the ground-retention members 116*a-b* connect to an anchor post that is recessed beneath the tennis court surface 808.

Looking back at FIG. 1, the ground retention members 116*a-b* span from a bottom of the middle portion 104, opposite the net-retention members 110*a-b*. The ground retention members span from the bottom of the middle portion 104 in opposing directions. Both ground-retention members 116*a-b* are disposed in off-set configurations with respect to the middle portion 104. In one non-limiting embodiment, the net-retention members 110*a-b* may be tubular stainless steel or other rigid material, e.g., PVC plastic. As FIG. 6 references, the ground retention members 116*a-b* may be offset at 36.05° and have a distance of 1.14" therebetween.

With reference to FIGS. 3, 5, and 7, the ground-retention members 116*a-b* may be disposed in an inversely symmetrical configuration or orientation with respect to a longitudinal and/or median axis of the unitary body 102. As seen best in FIGS. 4-5, the ground-retention members 116*a-b* may be offset from a transverse axis 204 of the unitary body 102 an approximately equal distance and may be disposed in an inversely symmetric orientation or configuration. In one non-limiting embodiment, the ground retention members are defined by a generally J-shaped hook.

Each ground-retention member 116*a*, 116*b* has an arcuate portion 122 forming corresponding ground-retention surfaces 120*a-b*. The ground-retention surfaces 120*a-b* face in a direction toward the net-support surface 114 of the net-retention members 110*a-b*. The ground retention surface 120*a-b* for each respective ground-retention member is aligned with one another and has a corresponding shape.

As FIG. 11 illustrates, the ground retention surfaces 120*a-b* are defined by a top surface that forms an anchor post insertion channel 124. The anchor post 810 insertion channels 124 receive an anchor post 810 that is recessed beneath the tennis court surface 808. The ground-retention members 116*a-b* may also include terminating distal free ground ends 118*a*, 118*b* to permit maneuvering of an anchor post 810 within the anchor post insertion channel 124.

In this manner, the J-shaped, arcuate configuration of the ground-retention members 116*a-b* are easily hooked around the anchor post 810 for connection thereto, and securement to the anchor post 810 recessed in the tennis court surface 808. For removal, the ground-retention members 116*a-b* are easily twisted to unhook from the anchor post 810. FIG. 11 illustrates the degree of rotation needed to unhook the ground-retention members 116*a-b* from the anchor post 810.

As shown in FIG. 2, the top surfaces of the ground-retention members 116*a-b* may be aligned with one another to prevent the anchor post 810 from being positioned in a non-planar orientation when supported with the top surfaces of the respective ground-retention members 116*a-b*. In one non-limiting embodiment, the anchor post 810 comprises a rigid hook member that is recessed below the tennis court surface 808.

As those of skill in the art will appreciate, the respective curved surfaces defining the anchor post insertion channel 124 will be shaped and sized to receive and/or support an anchor post 810 (typically found emended and secured within the ground surface). As such, when the anchor post 810 is inserted within the channel 124 it may be effectively supported by each top surface of the ground-retention members 116*a-b*. In this manner, the bottom surfaces of the net-retention members 110*a-b* effectively support the folded bottom portion 802 of the tennis net 800.

In operation, a method for anchoring a tennis net 800 to a tennis court surface 808 includes providing a tennis net 800 that stretches across a tennis court, and is supported by two posts at opposing ends. The center, bottom portion 802 of the tennis net 800 includes a center strap and forms bottom grommets 804 for height adjustable attachment to the anchor post 810.

When the bottom portion 802 of the net remains untethered, the tennis net 800 is allowed to sway laterally when struck by a tennis ball or affected by the wind. Thus, the anchoring device 100 is effective in anchoring this center region of the tennis net 800 to a recessed anchor post 810 in the tennis court surface 808.

The anchoring device 100 provides a middle portion 104 defined by an upper end 106 and a bottom end 108 opposing the upper end 106 of the middle portion 104. The height of the middle portion 104 dictates the distance/spacing of the net from the tennis court surface 808. Two net-retention members 110*a-b* extend downwardly from the upper end 106 of the middle portion 104 to define an arcuate net-support surface 114 facing in a direction toward the bottom end 108 of the middle portion 104.

Another step in the method includes hooking the net-retention members 110*a-b* through the bottom grommet 804 (FIG. 9) or wrapping the straps 1000*a-b* through the net-retention members 110*a-b* from the bottom portion 802 of the tennis net 800 (FIG. 10). This enables a bottom portion 802 of the tennis net 800 having a single folded strap with two grommeted or looped ends of the net-retention members 110*a-b* to attach to the anchor post 810.

Opposite the net-retention members 110*a-b*, extending downwardly from the bottom end 108 of the middle portion 104 are two ground-retention members 116*a-b*. Each ground-retention member is defined by an arcuate portion with a ground-retention surface 120*a-b* facing in a direction toward the net-support surface 114 of the net-retention members 110*a-b*. The ground retention surface is defined by a top surface that forms an anchor post insertion channel 124.

Another step includes the anchor post insertion channels 124 receiving the recessed anchor post 810. It is significant to note that the ground-retention members 116*a-b* may be aligned with one another to prevent the anchor post 810 from being positioned in a non-planar orientation when supported with the top surfaces of the respective ground-retention members 116*a-b*.

The J-shaped, arcuate ground-retention members 116*a-b* are easily hooked around the anchor post 810 for connection thereto, and then released to secure to the anchor post 810 recessed in the tennis court surface 808. The tennis net 800 is secured from the central, bottom portion 802 to the anchor post 810, and does not sway or misalign.

To detach the bottom portion 802 of the tennis net 800 from the anchor post 810, the net-retention members 110*a-b* are easily unhooked from the bottom grommet 804, and the ground-retention members 116*a-b* unhooked from the anchor post 810, in any order.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. An anchoring device comprising:

a unitary body of a rigid material including:

a middle portion being defined by an upper end and a bottom end opposing the upper end of the middle portion;

two net-retention members, each net-retention member extending downwardly from the upper end of the middle portion to define an arcuate net-support surface facing in a direction toward the bottom end of the middle portion, both net-retention members terminating at respective free net ends, both net-retention members flanking the middle portion; and two ground-retention members extending downwardly from the bottom end of the middle portion, each ground-retention member having an arcuate portion with a ground-retention surface facing in a direction toward the net-support surfaces of the net-retention members, both ground-retention members terminating at respective free ground ends, both ground-retention members being disposed in off-set configurations with respect to the middle portion, the unitary body, spanning from the free ground ends of the two ground-retention members to the free net ends, having no moving parts.

2. The anchoring device according to claim 1, wherein: the unitary body comprises a shaft defined by a generally linear shape.

3. The anchoring device according to claim 1, wherein: the two net-retention members form a generally arcuate T-shape.

4. The anchoring device according to claim 1, wherein: the arcuate net-support surface of each respective net-retention member is aligned with one another and have corresponding shapes.

5. The anchoring device according to claim 1, wherein: the net-retention members comprise a first arm that extends laterally from the middle portion of the unitary body in the same direction and orientation as a first ground-retention member.

6. The anchoring device according to claim 5, wherein: the net-retention members comprise a second arm that extends laterally from the middle portion of the unitary body in the same direction and orientation as a second ground-retention member.

7. The anchoring device according to claim 1, wherein: the two ground-retention members form a generally J-shape.

8. The anchoring device according to claim 1, wherein: the ground-retention surface of each respective ground-retention member is aligned with one another and have corresponding shapes.

9. The anchoring device according to claim 1, wherein: the ground-retention member is disposed in an inversely symmetrical orientation with respect to a longitudinal and median axis of the unitary body.

10. The anchoring device according to claim 1, wherein: the bottom end of the middle portion is oriented to a tennis court surface.

11. The anchoring device according to claim 10, wherein: The net-support surface is operable to enable support of a bottom grommet of a tennis net extending across the tennis court surface.

12. The anchoring device according to claim 11, wherein: The net-support surface is operable to enable wrapping a pair of straps around the net-retention members.

13. The anchoring device according to claim 12, wherein: the ground-retention surface forms an anchor post insertion channel operable to enable insertion of an anchor post recessed in the tennis court surface.

14. The anchoring device according to claim 13, wherein: the free ground ends are operable to enable maneuvering of the anchor post within the anchor post insertion channel.

15. The anchoring device according to claim 14, wherein: the anchor post comprises a rigid hook member.

16. The anchoring device according to claim 15, wherein:

the unitary body is further defined by a top portion oriented towards the tennis net, and a lower portion oriented towards the tennis court surface.

17. An anchoring device in combination with a tennis net having a net bottom portion including an aperture with a bottom grommet coupled thereto, the tennis net being selectively removably coupled at each opposing end to an anchor post, spanning a width of a tennis court defined by a tennis court surface, wherein a rigid anchor post is recessed below the tennis court surface, and, wherein the improvement comprises:

a unitary body of a rigid material including:

a middle portion with an upper end and a bottom end opposing the upper end of the middle portion;

two net-retention members each extending downwardly from the upper end of the middle portion to define an arcuate net-support surface facing in a direction toward the bottom end of the middle portion, the net-support surface being operable to enable support of the bottom grommet of the tennis net, both net-retention members terminating at respective free net ends, and both net-retention members flanking the middle portion; and two ground-retention members extending downwardly from the bottom end of the middle portion, each ground-retention member having an arcuate portion with a ground-retention surface facing in a direction toward the net-support surfaces of the net-retention members, the ground-retention surface forming an anchor post insertion channel operable to enable insertion of the anchor post, both ground-retention members terminating at respective free ground ends, the free ground ends being operable to enable maneuvering of the anchor post within the anchor post insertion channel, and both ground-retention members disposed in off-set configurations with respect to the middle portion, the unitary body, spanning from the free ground ends of the two ground-retention members to the free net ends, having no moving parts.

18. An anchoring device consisting of:

a unitary body of a rigid material defined by a top portion, a middle portion, and a lower portion, the unitary body further being defined by a generally linear shape, the unitary body including:

the middle portion being defined by an upper end and a bottom end opposing the upper end;

two net-retention members being defined by an arcuate T-shape, each net-retention member extending downwardly from the upper end of the middle portion to define an arcuate net-support surface facing in a direction toward the bottom end of the middle portion, the net-support surface of each respective net-retention member being aligned with one another and have a corresponding shape, both net-retention members terminating at respective free net ends, both net-retention members flanking the middle portion; and two ground-retention members being defined by a generally J-shape, the ground-retention members extending downwardly from the bottom end of the middle portion, each ground-retention member having an arcuate portion with a ground-retention surface facing in a direction toward the net-support surfaces of the net-retention members, the ground retention surface of each respective ground-retention member being aligned with one another and have a corresponding shape, both ground-retention members terminating at respective free ground ends, both ground-retention members being disposed in off-set configurations with respect to the middle portion, the unitary body, spanning from the free ground ends of the two ground-retention members to the free net ends, having no moving parts.

19. The anchoring device according to claim 18, wherein:

the net-support surface is operable to enable support of a bottom grommet of a tennis net extending across a tennis court surface.

20. The anchoring device according to claim 19, wherein:

the ground-retention surface forms an anchor post insertion channel operable to enable insertion of an anchor post recessed beneath the tennis court surface.

* * * * *